United States Patent [19]

Heiden

[11] Patent Number: 4,597,204

[45] Date of Patent: Jul. 1, 1986

[54] SNOW PUSHER WITH ADJUSTABLE HANDLE

[76] Inventor: Donald J. Heiden, 2520 Central Ave., Cody, Wyo. 82414

[21] Appl. No.: 741,624

[22] Filed: Jun. 5, 1985

[51] Int. Cl.[4] ..... E01H 5/02

[52] U.S. Cl. ..... 37/285; 15/144 R; 294/54.5; 294/57

[58] Field of Search ..... 37/284, 285; 294/54.5, 294/57–59; 15/144 R

[56] References Cited

U.S. PATENT DOCUMENTS

| | | | |
|---|---|---|---|
| 813,983 | 2/1906 | Luney | 294/54.5 |
| 1,389,249 | 8/1921 | Kitchel | 15/144 R |
| 1,847,133 | 3/1932 | Nieman | 15/144 R |
| 2,347,963 | 5/1944 | O'Neill | 37/285 |
| 2,463,150 | 3/1949 | Camp | 294/54.5 X |
| 2,785,483 | 3/1957 | Gajewski | 37/284 |
| 2,919,153 | 12/1959 | Benton | 294/57 |
| 3,078,604 | 2/1963 | Neuman | 294/57 |
| 3,091,790 | 6/1963 | Schroeder | 37/284 |
| 3,868,742 | 3/1975 | Brenner | 15/144 R |
| 4,524,484 | 6/1985 | Graham | 15/144 B X |

FOREIGN PATENT DOCUMENTS

| | | | |
|---|---|---|---|
| 109504 | 9/1917 | United Kingdom | 37/284 |
| 752739 | 7/1956 | United Kingdom | 294/57 |
| 923601 | 4/1963 | United Kingdom | 294/58 |

*Primary Examiner*—E. M. Eickholt

*Attorney, Agent, or Firm*—Harvey B. Jacobson

[57] ABSTRACT

A manual snow pusher comprises a resilient rubber blade connected along the base of a hood-like snow diverting member of galvanized metal plate. An elongate handle is pivotally attached to a latch plate at the back of the snow diverting member, allowing the angle of the handle relative to the length of the blade to be adjusted. The handle has a spring loaded pin which can be engaged in any one of a series of holes formed around the arcuate periphery of the latch plate in order to releasably secure the handle in a selected angular position.

2 Claims, 4 Drawing Figures

SNOW PUSHER WITH ADJUSTABLE HANDLEBACKGROUND OF THE INVENTION

This invention relates to a snow pusher for manual use in clearing driveways, walkways, or pavement surfaces in general of snow and the like.

For manual snow clearance, use is generally made of a snow shovel or pusher of the type having a relatively stiff steel or plastic blade and a fixed rigid handle. Devices of this nature are in very common use, but suffer from certain disadvantages. For example, the blades tend to scuff against hidden obstacles or rough pavement surfaces, leading to premature blade damage. Generally the blades of known devices are not replaceable, so that the shovel or pusher as a whole has a limited useful life span dictated by blade wear. Further, with the handle fixed rigidly to the blade, usually in perpendicular relation thereto, the versatility of the device is somewhat limited.

The invention provides an improved form of manual snow pusher having, inter alia, a longer lasting and replaceable type blade, and a handle which can be moved to different operating positions relative to the blade thereby increasing the versatility of the device.

DISCLOSURE STATEMENT

Applicant is aware of the following U.S patents pertaining to snow pushing devices and the like. None of these, however, discloses a device having the features of the present invention.

U.S. Pat. No. 1,196,206, 8-29-16
U.S. Pat. No. 1,524,639, 1-27-25
U.S. Pat. No. 2,239,297, 4-22-41
U.S. Pat. No. 2,967,363, 1-10-61
U.S. Pat. No. 3,473,838, 10-21-69

SUMMARY OF THE INVENTION

The invention provides a manual snow pusher which has an elongate blade of resilient material, such as rubber, releasably secured along a bottom edge of a hood-like snow-diverting member, with a forwardly directed upper edge, and an upwardly inclined elongate handle attached in back of the snow diverting member preferably by means of an adjustable swivel attachment allowing the angle of the handle relative to the longitudinal extent of the blade to be selectively adjusted. The handle may, for example, be pivotally secured to an arcuate latch plate on the back of the snow diverting member, and may carry a spring-loaded latch pin which can be selectively latched in any one of a pluralilty of holes formed in the arcuate periphery of the latch plate, whereby the handle may be releasably latched in a selected angular position.

In use, the resilient blade tends to conform to or hug a surface being cleaned and provide more efficient cleaning than a rigid blade. The resilient blade, moreover does not have the same tendency to catch on expansion joints in walkways or on other protruding objects. Rather, a resilient blade tends to slide over and around protrusions. Further, it is easy to quiet and push and can be used as a squeegee to expel water and other liquids from flat surfaces. It does not tend to scratch or damage surfaces and is longer lasting than a rigid blade.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
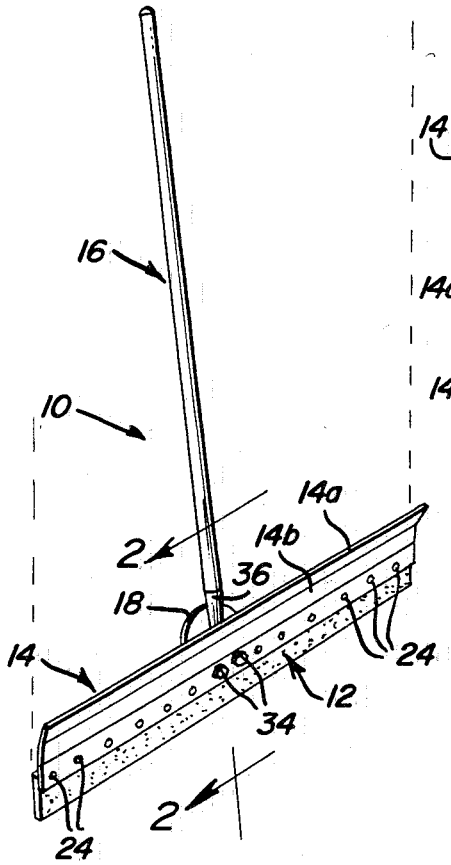
FIG. 1 is a perspective view of a manual snow pusher in accordance with the invention.
Figure 3:
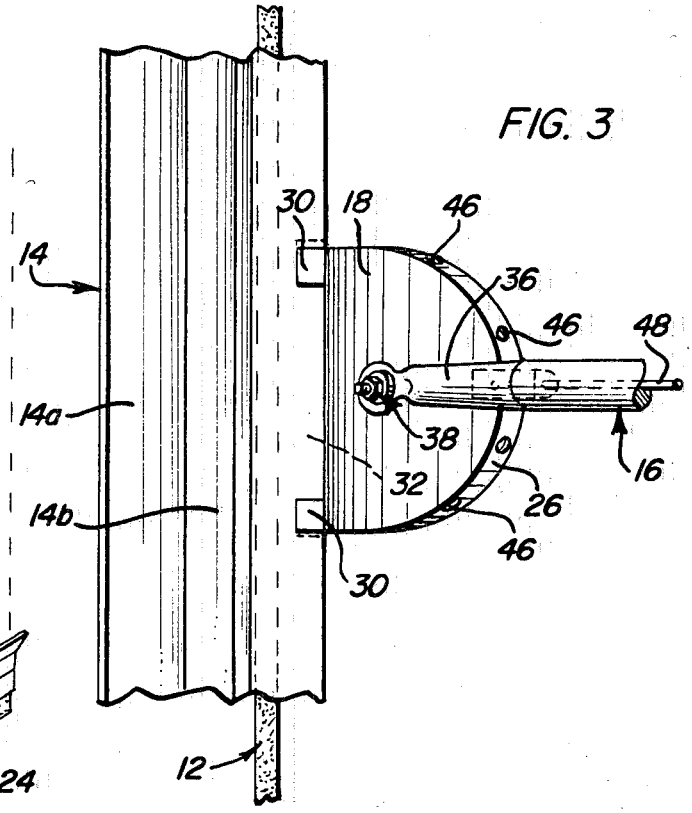
FIG. 3 is a sectional view on line 3—3 of FIG. 2.

The illustrated snow pusher 10 comprises an elongate blade 12 of rubber or like resilient material, which may, for example, be about ¼ inch thick, two inches high, and 30 to 36 inches long, secured as will be described along the base of a hood-like snow-diverting member 14, and a swiveling handle 16 pivotally attached to a latch plate 18 on the back of member 14.

The snow diverting member 14 may be made of 26 gauge galvanized sheet metal about 8 inches high and having its upper edge portions 14*a* and 14*b* bent forwardly as shown. Blade 12 may be trapped between an elongate angle iron 20 and a flat strap 22, these three items being secured along the bottom edge of member 14 by aligned holes in the respective members and thumb screws, wing nuts or the like, not shown but being indicated diagramatically by references 24.

Figure 2:
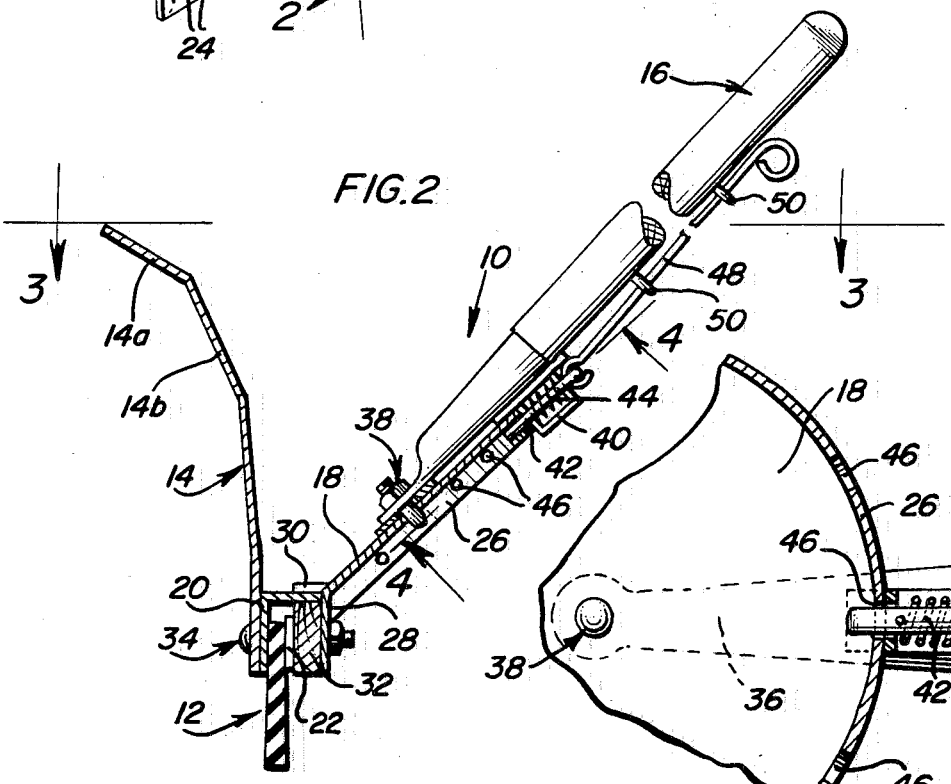
FIG. 2 is an enlarged sectional view on line 2—2 of FIG. 1.
Figure 4:
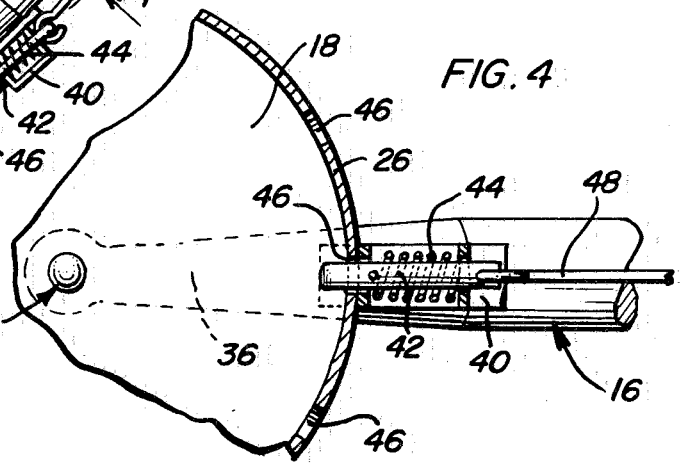
FIG. 4 is a sectional view on line 4—4 of FIG. 2.

Centrally of member 14 there is a gap between the respective fastener devices 24 for attachment of latch plate 18. The latch plate is a generally semi-circular metallic plate having a depending arcuate peripheral flange 26 and a substantially flat front flange 28 with upturned tabs 30. Flange 28 fits against a wooden or like spacer 32 placed behind strap 22 with tabs 30 fitting on top of angle iron 20 as shown in FIG. 2. The latch plate is attached to the assembly of diverting-member 14 and blade 12 by a pair of bolt and nut connectors 34. The length of latch plate 14 may be about 7½ inches and the plate body may be bent relative to flange 28 and tabs 30 at an angle of about 45 degrees.

Handle 16 may have a flattened metal collar 36 at its forward end with a hole therethrough whereby the handle is pivotally secured to the center of latch plate 18 by a swivel connector assembly 38 comprising a swivel bolt, suitable lock nuts, washers and a lock washer. Thus, the handle may be swiveled in order to change its angle relative to the length of blade 12. In order releasably to latch the handle in selected angular position, the handle is provided with a screw-on latch attachment comprising a latch housing 40 carrying a latch pin 42 with a surrounding coil spring 44 which biases the pin toward the forward end of the handle. The pin is adapted to engage in any one of a series of holes 46 formed in latch plate flange 26, and may be withdrawn from the selected hole against the spring action by means of a wire trigger rod 48 secured to the pin and extending along the handle 16. The rod may be held against the handle by staples 50 or the like. It will be understood that the handle may thus easily be moved from one angular position to another simply by disengaging the latch pin from one of the holes 46, swiveling the handle, and reengaging the latch pin in another one of the holes.

Holes 46 preferably may include extreme end holes for locating the handle substantially in parallel with blade 12 for compact storage of the device, a central hole for locating the handle perpendicularly to the blade for straight ahead snow pushing, and at least one left hand and right hand intermediate hole for locating the handle at an acute angle to the blade for angled snow pushing in the manner of a snow plow. The snow pusher can thus be used both for straight ahead snow removal or for pushing snow at an angle, since there are applications in which one or other technique is more suitable, and the device can be expeditiously adjusted as between the two positions as well as to a storage position.

The snow pusher can be easily dismantled and reassembled, and the blade can readily be replaced when worn. Further, the blade lends itself to reuse in an inverted position when one edge is worn, thereby economizing further on blade use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A snow pusher comprising an elongated, rigid snow diverting member, said member being generally in the form of a rectangular plate oriented vertically with the upper edge portion including horizontal portions inclined forwardly in the direction of snow to be pushed, an elongated blade extending continuously from end to end of said plate along the lower edge thereof and forming a vertical continuation of said plate, said blade being constructed of resilient, wear-resistant material for sliding movement on a surface from which snow is to be removed without catching on irregularities in said surface, a push handle extending in an upwardly inclined manner from said plate opposite to the inclined horizontal portions, and means connecting the lower end of the handle with said plate to enable the pusher to be manually operated by exerting longitudinal thrust on said handle, said means connecting the handle with said plate including an elongated angle iron member having a vertical flange attached to the rear surface of the lower edge of said plate and a horizontal flange extending rearwardly from the top edge of the vertical flange, fastening means extending through the lower edge of said plate, through said vertical flange and through the upper edge of said blade for removably mounting the blade from said plate, a mounting plate having an arcuate edge portion and a straight edge portion in opposed relation to the arcuate edge portion, the straight edge portion of said mounting plate engaging the rear edge of said horizontal flange of the angle iron member and including a downwardly extending mounting flange oriented vertically and a pair of forwardly projecting tabs oriented horizontally and engaged with the top surface of the horizontal flange, said mounting plate extending upwardly and rearwardly from the rear edge of said horizontal flange, said fastener means including centrally located fastener means extending through the mounting flange to securely mount the mounting plate from the plate forming the snow diverting member, said arcuate edge portion of the mounting plate including a depending flange with spaced apertures therein, said handle including a collar on one end, a pivot bolt extending through the end of the collar and said mounting plate at the center of curvature of the arcuate flange for pivotal movement about an axis inclined upwardly and forwardly toward the plate forming the snow diverting member, a reciprocating latch pin mounted on said handle adjacent the arcuate flange for engaging the apertures in the arcuate flange to enable adjustment of the handle about the inclined axis, spring means biasing the pin toward said arcuate flange, and an operating rod connected to the end of the pin remote from the arcuate flange and extending substantially throughout the length of the handle to enable retraction of the pin to enable angular adjustment of the handle.

2. The snow pusher as defined in claim 1 together with an elongated rigid strap member engaging and reinforcing the rear surface of the top edge portion of the blade with the fastener means extending therethrough, said mounting flange being spaced from the rigid strap member, and a spacer between the mounting flange and the strap member with the spacer having a length generally equal to the length of the mounting flange with the centrally located fastener means extending through the spacer member, said reciprocating pin being supported by a longitudinally extending bracket secured to the under surface of the handle, said bracket including depending apertured flanges slidingly receiving said pin, one end of said bracket extending into overlying relation to a portion of the mounting plate adjacent the arcuate edge portion thereof to engage the top surface of the mounting plate in opposed relation to the point of engagement between the pin and the depending flange on the mounting plate when the pin is in latched position.

* * * * *